US007364054B2

(12) United States Patent
Klein

(10) Patent No.: US 7,364,054 B2
(45) Date of Patent: Apr. 29, 2008

(54) DISPENSING TOOL

(75) Inventor: Manfred Klein, Kaufering (DE)

(73) Assignee: Hilti Aktiengesellschaft, Schaan (LI)

( * ) Notice: Subject to any disclaimer, the term of this patent is extended or adjusted under 35 U.S.C. 154(b) by 447 days.

(21) Appl. No.: 11/122,889

(22) Filed: May 5, 2005

(65) Prior Publication Data

US 2005/0247738 A1 Nov. 10, 2005

(30) Foreign Application Priority Data

May 10, 2004 (DE) ..... 10 2004 023 514

(51) Int. Cl.
*B65D 88/54* (2006.01)

(52) U.S. Cl. ..... 222/334; 222/391

(58) Field of Classification Search ..... 222/334, 222/373, 384, 389, 394, 395, 327–328, 340, 222/333, 391
See application file for complete search history.

(56) References Cited

U.S. PATENT DOCUMENTS 4,171,072 A * 10/1979 Davis, Jr. ..... 222/326
6,241,130 B1 * 6/2001 Heiberger ..... 222/325
6,264,071 B1 * 7/2001 Dentler ..... 222/391
6,766,923 B1 * 7/2004 Huang ..... 222/327

* cited by examiner

*Primary Examiner*—Lien M. Ngo
(74) *Attorney, Agent, or Firm*—Abelman, Frayne & Schwab

(57) ABSTRACT

A tool for dispending one- or multi-component masses contained in cartridges or foil bags includes at least one handle (4; 34; 54), at least one piston rod (5; 35; 55) a displacement mechanism (6; 56) for displacing the at least one piston rod (5; 35; 55) and having at least one displacement member (8) and a locking member (9) which are arranged on the at least one piston rod (5; 35; 55), are axially displaceable, and are pivotable in a longitudinal direction of the tool (1; 31; 51), and a force transmission device (21; 41; 61) acting on the displacement member (8) and having a switching element (22; 42; 62) arranged on the handle (4; 34; 54) and actuatable by an actuation member (12; 57) provided on the handle, and an actuator (24; 44; 64) for actuation of the at least one displacement member (8) and communicating with the switching element (24; 44; 64).

6 Claims, 3 Drawing Sheets

DISPENSING TOOL

BACKGROUND OF THE INVENTION

1. Field of the Invention

The present invention relates to a tool for dispensing one- or multi-component masses contained in cartridges or foil bags and which includes a housing, at least one handle provided on the housing, at least one piston rod displaceable in the housing, a displacement mechanism for displacing the at least one piston rod and having at least one displacement member and a locking member which are arranged on the at least one piston rod, are axially displaceable, and are pivotable in a longitudinal direction of the tool, a force transmission device acting on the displacement member, and at least one actuation member for actuating the force transmission device.

2. Description of the Prior Art

One- or multi-component chemical masses are used for different purposes as mortar, glue, or sealing masses in constructions, vehicles, aircrafts, ships, machines, and numerous other apparatuses. Conventionally, the masses are supplied to users in foil bags or cartridges. The foil bags or cartridges are placed in corresponding tools, and the masses are dispensed therefrom.

Suitable dispensing tools have, e.g., mechanical displacement mechanisms for displacing a piston rod that provides for forcing the mass out. German publication DE 36 07 384 A1 discloses a tool for displacing one- or multi-component masses from foil bags and cartridges and including a housing with a handle, a piston rod for forcing the mass out and which is displaceable by a displacement mechanism. The displacement mechanism has a displacement member and a locking member which are arranged on the piston rod, are axially displaceable, and pivot in the longitudinal direction of the tool between two end stops. On the handle, there is provided an actuation member upon actuation of which, a force transmitting element, which is formed as a multi-arm lever, acts on the displacement member, pivoting the same. The piston rod is displaced in the dispensing direction in accordance with the available lever path. The locking member prevents an undesirable movement of the piston rod in the opposite direction, i.e., in the direction opposite the dispensing direction. A release lever can so pivot the locking member that the piston rod would return to its initial position.

German Publication DE 42 31 418 A1 disclosed another tool for dispensing one- or multi-component masses contained in foil bags or cartridge and in which the actuation member is formed as a two-arm lever, with one arm of the lever acting directly on the displacement member for displacing the piston rod upon actuation of the lever.

Mechanical tools are characterized, in particular, by a low susceptibility to interference. These tools are easily handled and can be used in different applications. The drawback of the known tools consists in that for glutinous one- or multi-components masses which are located in the tools, for actuation, application of a large force is necessary, so that with a lasting operation, the user becomes tired. In addition, with actuation levers, the transmission ratios are low. If, e.g., very large forces with a short displacement path should be realized with the actuation member, the second lever length in, e.g., DE 42 31 418 A1 should be very small. With such a lever, the force application point lies close to the rotational axis of the lever.

Because of the mechanical design of the force transmission device, the arrangement of the lever is predetermined.

Dependent on type and weight of a dispensable foil bag or cartridge and on a further use of the residual amount of the dispensed masses, the weight ratios of the dispensing tools change, and the tools are not any more in an equilibrium. As a result, an unbalanced, e.g. top heavy tool leads during a lasting operation to fatigue of the user.

In addition to mechanical tools, pneumatic tools for dispensing of one- or multi-component masses, which are contained in foil bags or cartridges, are known. German Publication DE 40 32 349 A1 discloses such a pneumatic tool in which a piston rod, which is displaceable in a hollow cylinder, is displaced by compressing air for dispensing a dispensable mass. The drawback of the tool of DE 40 32 349 A1 consists in that because of numerous seals and constructive elements, the tool has a certain tendency to fail. Further, for operating a pneumatic tool, an external source of compressed air must be available.

Also known are hydraulic tools for dispensing one- or multi-component masses contained in foil bags or cartridges. German Publication DE 42 29 956 A1 discloses a hydraulic tool for dispensing a mass from a foil bag in which a dispensing piston is displaced by a pressure fluid upon actuation of an actuation member provided on the handle. This tool likewise is prone to failure because of numerous seals and constructive elements.

Accordingly, an object of the present invention is to provide a tool for dispensing one- or multi-component masses contained in the foil bags in which the above-mentioned drawbacks of known tools are eliminated and which remains user-friendly even during a lasting operation.

SUMMARY OF THE INVENTION

This and other objects of the present invention, which will become apparent hereinafter, are achieved, according to the invention, by providing a dispensing tool the force transmission device of which has a switching element arranged on the handle, an actuator for actuation of the displacement member and a connection element connecting the switching element with the actuator.

Because of an independent force transmission device, which consists of a switching element and the actuator and which can be disconnected from the displacement member, the handle, together with the actuation member, can be arranged on the housing at any arbitrary location, dependent on the available length of the connection element. This provides for an optimally ergonomic design of the tool. The use of a disconnectable force transmission device permits to adapt the necessary displacement of the actuation member to ergonomical requirements. The actuation member can be formed, e.g., as a lever that performs, upon actuation, a pivotal or parallel movement or combination of these movements.

Further, a tool having a repositional handle can be easily used at locations accessible only with much difficulty. Advantageously, on the housing there is provided a guide along which the handle can be displaced and then secured at a predetermined location. The handle can be secured on the housing with any suitable means such as clamping mechanisms, fixing screws, or the like. The inventive dispensing tool retains all of the advantages of mechanical tools such as performance capability and a low susceptibility to failure.

If a tool for dispensing of one- or multi-component masses contained in foil bags or cartridges has more than one piston rod, the displacement mechanism can have one displacement member common for all of the piston rods or a separate displacement member for each of the piston rods.

Likewise, there can be provided a single actuator acting on all of the displacement members, if several are used, or a separate actuator for each of the displacement members. The actuator can also act on the displacement members indirectly, via an intermediate connection link. When an intermediate link is used, the force, which is applied by the actuator, can be distributed between several displacement members. Alternatively, when a separate actuator is provided for each displacement member or for each piston rod, advantageously, they are actuated by a common switching element. It is also possible to provide on the handle several switching elements for the actuators.

Advantageously, the switching element and the actuator are formed, respectively, as hydraulic cylinders, and the connection element is formed as a hydraulic conduit. The actuation member is formed as a lever pivotally arranged on the handle. The lever, upon its actuation, acts on a ram of the first cylinder that forms the switching element. Upon actuation of the switching element, the first hydraulic cylinder, the pressure fluid flows through the hydraulic conduit to the second hydraulic cylinder that forms the actuator, and the ram of the second hydraulic cylinder displaces the displacement member, displacing the piston rod in the dispensing direction. Upon release of the actuation member, the ram of the actuator is displaced back into its initial position, indirectly, by a spring acting on the displacement member, or actively or directly, by a spring provided in the second cylinder. The advantage of this embodiment consists in that a little force is required for dispensing the one- or multi-component mass contained in a foil bag or a cartridge. The force ratio between the switching element and the actuator can be selected in accordance with a necessary force that is required for dispensing a mass. Further, the hydraulic cylinder, which acts as a switching element, can be displaceably arranged on the handle, which permits to establish different transmission ratios, without a need to replace the force transmitting device. Alternatively, the switching element can be formed as a electrical or electronic contact element upon actuation of which, a pump is actuated that feeds a pressure fluid through the hydraulic conduit to the second cylinder.

Instead of a hydraulic force transmission device a pneumatic force transmission device can be used. As a compressed air source, e.g., a replaceable pressure or aneroid capsule can be use, so that no external compressed air source is required. According to an embodiment of the invention, instead of hydraulic force transmission device, an electrical and/or electronic force transmission device is used. With the electric and/or electric device, the switching element is formed as a contact element, the actuator is formed as a solenoid, and the connection element is formed as an electrical conductor. As an energy source for the electrical and/or electronic force transmitting device, e.g., an accumulator can be provided. Alternatively, the actuator can be formed as an electric motor that, e.g., pulls back a ram acting on the displacement member or actuates the displacement member directly via a gear arrangement.

With all types of the force transmission device, the device and the handle can be formed as a unit securable on the tool housing. This unit can be entirely replaced, if needed, to provide for different transmission ratios for displacing the piston rod. In particular, with a hydraulic force transmission device, the hydraulic system remains closed during the exchange of the unit. This insures a high performance capability.

Advantageously, the connection element, the conduit or the electrical conductor, is releasably connected with the switching element and/or the actuator. The conduit can be connected, e.g., by appropriate coupling means such as a sealed bayonet joint, the conductor can be connected using, e.g., plug-and-socket connection. As a result, conduits or conductors having different length can be used with the tool in order to widen or to narrow the positioning region in which the handle can be mounted on the housing. With a conductor or conduit length corresponding to the maximal desired adjustment path of the handle, the number of conduit or conductor sections suspended from the tool can be limited. The conduit or conductor can be secured on holding elements provided on the housing.

With a releasable conduit or conductor, different types of handles with different switching elements or different actuators can be provided on one and the same tool, without changing the tool configuration. This permits to adapt a tool and, thus, its application to different types of dispensing masses and to different material characteristics.

Advantageously, another force transmission device for actuating the locking member for releasing the at least one position rod is provided in the dispensing tool. The design of the another force transmission device is preferably corresponds to the design of the force transmission device for displacing the piston rod.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

The drawings show.

In the drawings the same elements are designated with the same reference numerals.

DETAILED DESCRIPTION OF THE PREFERRED EMBODIMENT

Figure 1:
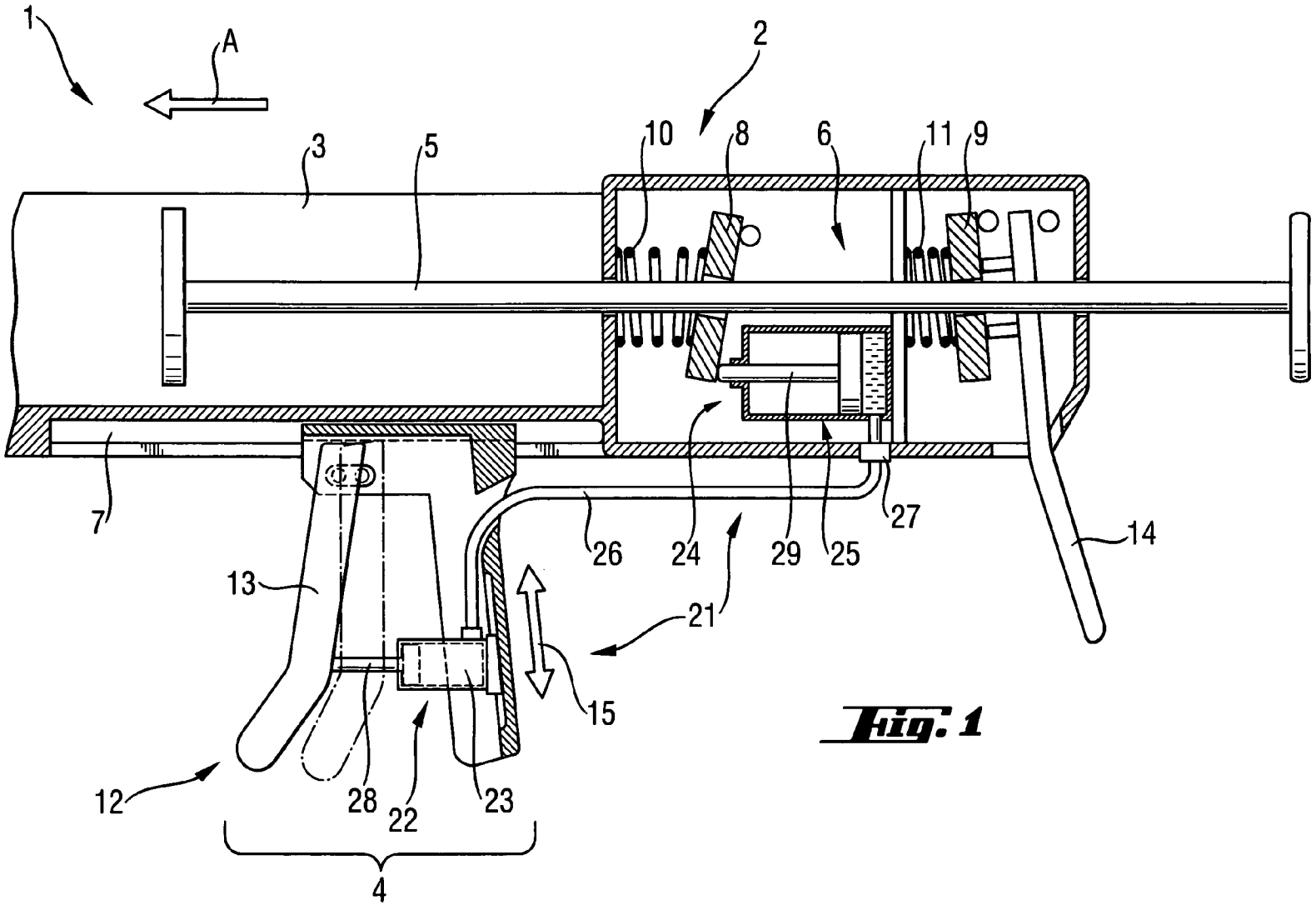
FIG. 1 a longitudinal cross-sectional view of a first embodiment of a dispensing tool according to the present invention.

FIG. 1 shows a dispensing tool 1 according to the present invention for dispensing one- or multi-component mass that is contained in a foil bag or a cartridge. The dispensing tool 1 has a housing 2 with a receptacle 3, in which the foil bag or cartridge can be located, a handle 4, a piston rod 5 displaceable in the housing 2, and a displacement mechanism 6 located in the housing 2. The dispensing tool further includes a hydraulic force transmitting device 21. The displacement mechanism 6 has a displacing member 8 and a locking member 9 which are arranged on the piston rod 5 for an axial displacement therewith and which pivot in a longitudinal direction of the housing 2. The displacing member 8 and the locking member 9 are subjected to biasing forces of first and second springs 10 and 11, respectively. On the handle 4, there is provided an actuation member 12 which is formed as an articulated actuation lever 13 supported for linear movement parallel to itself and for pivotal movement. The handle 4 is displaceable along the guide 7 and is secured in a predetermined position on the housing 2 with appropriate means not shown in detail.

The hydraulic force transmitting mechanism 21 includes a switching element 22 which is formed as a first hydraulic cylinder 23, and an actuator 24 which is formed as a second hydraulic cylinder 25 connected with the first hydraulic cylinder 23 by a conduit 26. The conduit 26 is fixedly connected with the first hydraulic cylinder 23 and is releasably connected with the second hydraulic cylinder 25 by a coupling 27. Upon actuation of the lever 13, the plunger 28 of the first hydraulic cylinder 23 is displaced therein, causing flow of a pressure fluid, e.g., a hydraulic oil that fills the first hydraulic cylinder 23, through the conduit 26 toward the second hydraulic cylinder 25. The pressure fluid that flows into the second hydraulic cylinder 25 displaces the plunger 29 leftwardly, pivoting the displacement member 8 against the biasing force of the spring 10. The pivotal movement of the displacement member 8 causes the displacement of the piston rod 5 in the dispensing direction A. Upon release of the actuation lever 13, the biasing force of the spring 10 displaces the displacement member 8 into its initial position and which, in turn, displaces, via the plunger 29 of the second hydraulic cylinder 25 to its initial position. The displacement of the plunger 29 of the second hydraulic cylinder 25 causes the pressure fluid to flow out of the second hydraulic cylinder 25 and through the conduit 26 into the first hydraulic cylinder 23. As a result, the ram 28 of the first hydraulic cylinder 23 moves leftwardly, and the dispensing tool 1 is ready to perform a dispensing process anew. The first hydraulic cylinder 23 is arranged on the handle 4 for displacement in a direction of double arrow 15. This permits to obtain different transmission ratios of the hydraulic force transmission device 21 in the dispensing tool 1, without a need to replace the force transmission device 21.

For replacing a used cartridge or for inserting a new one or for replacing a foil bag, the locking member 9 is pivoted against the biasing force of the spring 11 with a release lever 14 in such a way that the piston rod 5 is pulled back to its initial position.

A dispensing tool 31 according to the second embodiment substantially corresponds to the dispensing tool 1 described above. The difference between the dispensing tool 1 and the dispensing tool 31 consists in that for releasing of the piston rod 35, a second hydraulic force transmission device 41 is provided, in addition to the first force transmission device 21. The second hydraulic force transmission device 41 has a switching element 42 which is provided on the handle 34 and which is formed as a hydraulic cylinder 43, and an actuator 44 which is formed as a hydraulic cylinder 45. The hydraulic cylinder 45 is connected with the hydraulic cylinder 43 by a conduit 46 which is fixedly connected with the switching element-forming hydraulic cylinder 43 and is releasably connected with the actuator-forming hydraulic cylinder 45 by a coupling 47. Upon actuation of the actuation lever 33, the actuator-forming hydraulic cylinder 45 of the second force transmission device 41 is actuated and releases the piston rod 35. The tool housing 32 is provided with holding elements 36 for supporting the hydraulic conduits 26 and 46.

Figure 2:
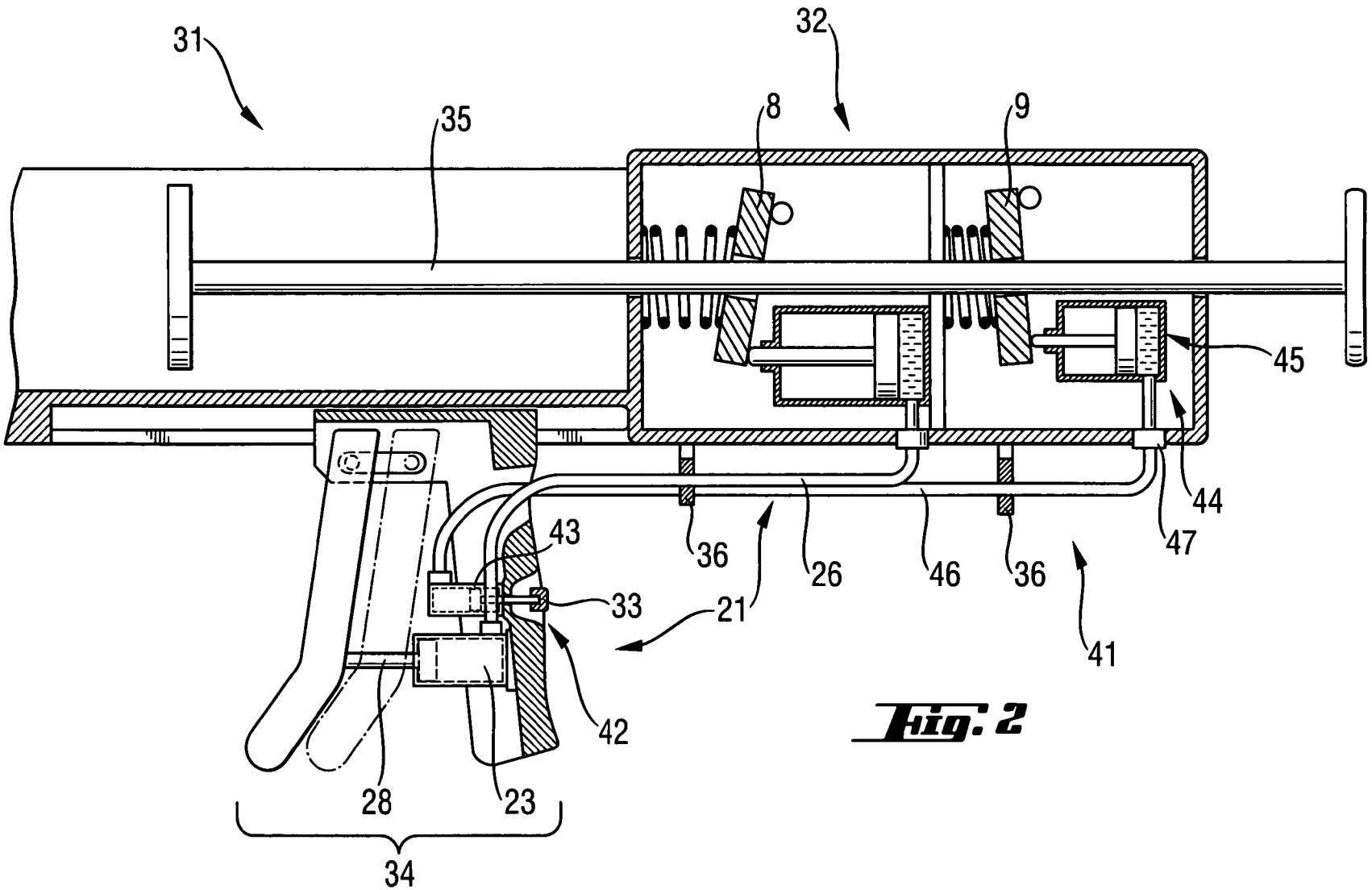
FIG. 2 a longitudinal cross-sectional view of a second embodiment of a dispensing tool according to the present invention.
Figure 3:
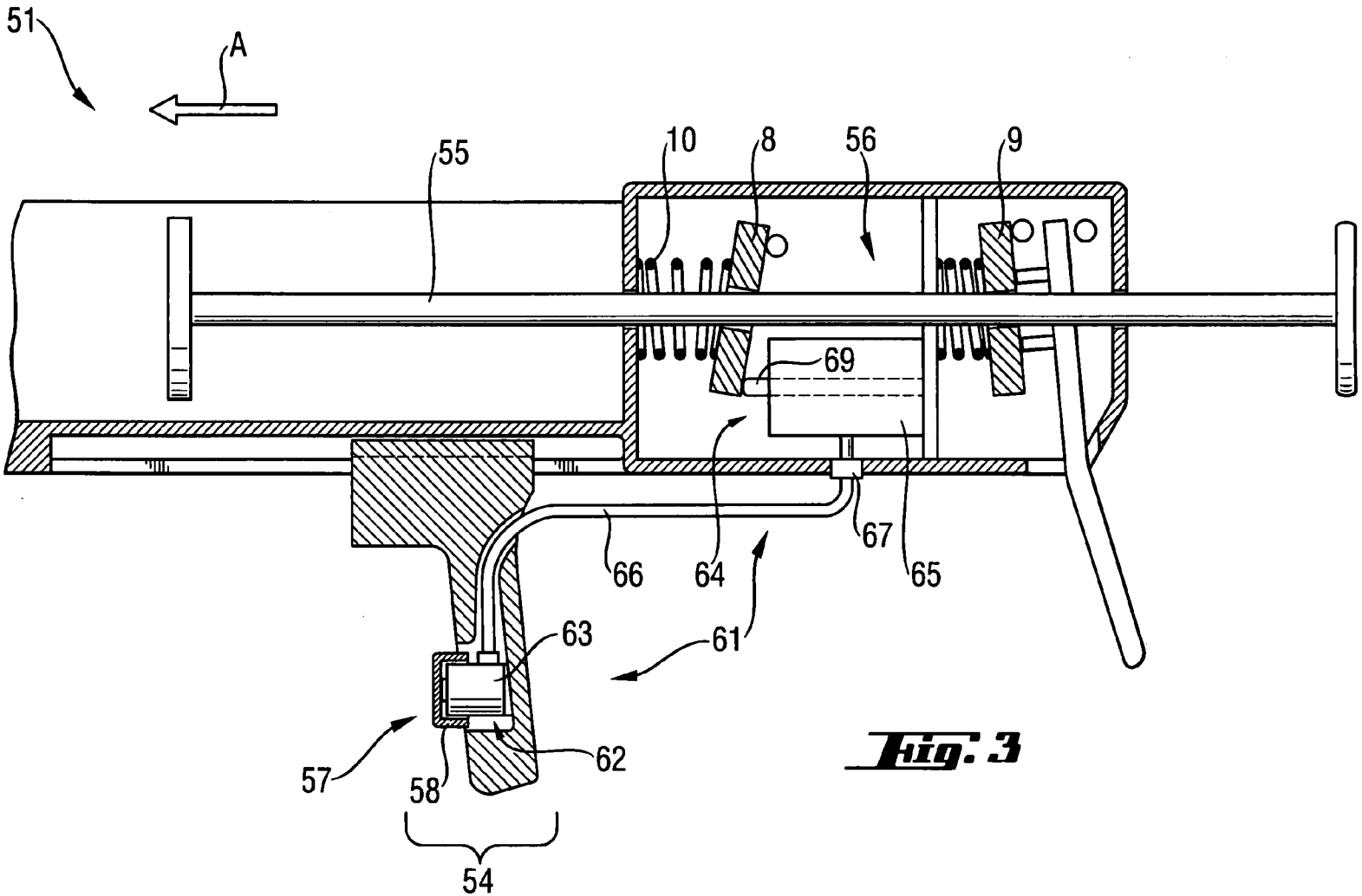
FIG. 3 a longitudinal cross-sectional view of a further embodiment of a dispensing tool according to the present invention.

A dispensing tool 51 for dispensing one- or multi-component masses contained in foil bags or cartridges an which is shown in FIG. 3, has an electrical and/or electronic force transmission device 61. In the dispensing tool 51, the displacement mechanism 56 is substantially the same as the displacement mechanism 6 of the dispensing tool 1 or 31 which are shown in FIGS. 1 and 2, respectively.

The electrical and/or electronic force transmitting device 61 has a switching element 62 which is formed as a contact element 63, and an actuator 64 which is formed as a solenoid 65. The contact element 63 is connected with the solenoid 65 by an electrical conductor 66. The electrical conductor 66 is releasably connected with the solenoid 65 by plug-and-socket connection means 67. On the handle 64, there is provided an actuation member 57 which is formed as a press switch 58. Upon activation of the press switch 58, the contact element 63 generates an electrical signal that is communicated to the solenoid 65 via the electrical conductor 66. Upon actuation of the solenoid 65, its core 69 is displaced leftwardly, pivoting the displacement member 8 against the biasing force of the spring 10, whereby the piston rod 55 is displaced in the dispensing direction A. Upon release of the press switch 58, the spring 10 biases the displacement member 8 in its original position, whereby the core 69 of the solenoid 65 returns to its initial position.

Though the present invention was shown and described with references to the preferred embodiments, such are merely illustrative of the present invention and are not to be construed as a limitation thereof and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A tool for dispensing one- or multi-component masses contained in cartridges or foil bags, comprising a housing (2; 32); at least one handle (4; 34; 54) provide on the housing (2; 32); at least one piston rod (5; 35; 55) displaceable in the housing (2; 32); a displacement mechanism (6; 56) for displacing the at least one piston rod (5; 35; 55) and having at least one displacement member (8) and a locking member (9) which are arranged on the at least one piston rod (5; 35; 55), are axially displaceable, and are pivotable in a longitudinal direction of the tool (1; 31; 51); a force transmission device (21; 41; 61) acting on the displacement member (8) and having a switching element (22; 42; 62) arranged on the handle (4; 34; 54), an actuator (24; 44; 64) for actuation of the at least one displacement member (8), and connection means (26; 46; 66) for connecting the switching element (22; 42; 62) with the actuator (24; 44; 64); and at least one actuation member (12; 57) for actuating the switching element (22; 42; 62) of the force transmission device (21; 41; 61), wherein the switching element (22; 42) and the actuator (24; 44) are formed, respectively, as hydraulic cylinders (23, 25, 43, 45), and the connection means (26; 46) is formed as a hydraulic conduit.

2. A dispensing tool according to claim 1, wherein the connection means (26; 46; 66) is releasably connected with at least one of the switching element (22; 42; 62) and the actuator (24; 44; 64).

3. A dispensing tool according to claim 1, further comprising another force transmission device (41) for actuating the locking member (9) for releasing the at least one piston rod (35).

4. A tool for dispensing one- or multi-component masses contained in cartridges or foil bags, comprising a housing (2; 32); at least one handle (4; 34; 54) provide on the housing (2; 32); at least one piston rod (5; 35; 55) displaceable in the housing (2; 32); a displacement mechanism (6; 56) for displacing the at least one piston rod (5; 35; 55) and having at least one displacement member (8) and a locking member (9) which are arranged on the at least one piston rod (5; 35; 55), are axially displaceable, and are pivotable in a longitudinal direction of the tool (1; 31; 51); a force transmission device (21; 41; 61) acting on the displacement member (8) and having a switching element (22; 42; 62) arranged on the handle (4; 34; 54), an actuator (24; 44; 64) for actuation of the at least one displacement member (8), and connection means (26; 46; 66) for connecting the switching element (22; 42; 62) with the actuator (24; 44; 64); and at least one actuation member (12; 57) for actuating the switching element (22; 42; 62) of the force transmission device (21; 41; 61), wherein the switching element (62) is formed as a contact element (63), the actuator (64) is formed as a solenoid (65), and the connection means (66) is formed as an electrical conductor.

5. A dispensing tool according to claim 4, wherein the connection means (26; 46; 66) is releasably connected with at least one of the switching element (22; 42; 62) and the actuator (24; 44; 64).

6. A dispensing tool according to claim 4, further comprising another force transmission device (41) for actuating the locking member (9) for releasing the at least one piston rod (35).

* * * * *